United States Patent [19]

Düll et al.

[11] 4,393,786

[45] Jul. 19, 1983

[54] TRACK CROSSING FOR A TWO TRACK SUSPENSION RAILROAD

[75] Inventors: Hans J. Düll, Langensendelbach; Adolf Hillmer, Erlangen, both of Fed. Rep. of Germany

[73] Assignee: Siemens Aktiengesellschaft, Munich, Fed. Rep. of Germany

[21] Appl. No.: 213,674

[22] Filed: Dec. 5, 1980

[30] Foreign Application Priority Data

Dec. 12, 1979 [DE] Fed. Rep. of Germany ..... 2950017

[51] Int. Cl.[3] ..... E01B 25/12

[52] U.S. Cl. ..... 104/141; 104/130; 191/37; 191/38

[58] Field of Search ..... 104/96, 98, 130, 131, 104/141, 139, 140, 94; 105/141, 144; 191/38

[56] References Cited

U.S. PATENT DOCUMENTS

| | | | |
|---|---|---|---|
| 456,434 | 7/1891 | Samuel | 104/141 |
| 613,175 | 10/1898 | Robb | 104/141 |
| 3,789,765 | 2/1974 | Schultz | 104/96 |
| 3,838,648 | 10/1974 | Dahlberg et al. | 104/140 |
| 3,859,925 | 1/1975 | Hartz | 104/140 |
| 3,913,491 | 10/1975 | Aver | 104/96 |
| 3,913,492 | 10/1975 | Dull | 104/96 |

FOREIGN PATENT DOCUMENTS

| | | | |
|---|---|---|---|
| 2237005 | 7/1973 | France | 104/141 |

*Primary Examiner*—Richard A. Bertsch
*Attorney, Agent, or Firm*—Kenyon & Kenyon

[57] ABSTRACT

A track crossing for a carriage of a two track suspension railroad arranged in a box girder has, on both sides of a slot provided in the lower flange of the box girder, running surfaces for support wheels, and at the sidewalls of the box girder, current rails and parallel guide surfaces for lateral guide rollers. For bridging and unused track two slewable support members with lateral guide surfaces and, optionally, running surfaces for the support wheels are provided. Current rails are arranged on at least one of the support members. The support members can be swung into depressions of the fixed sidewalls of the box girder of the one or the other track.

5 Claims, 7 Drawing Figures

TRACK CROSSING FOR A TWO TRACK SUSPENSION RAILROAD

BACKGROUND OF THE INVENTION

The invention relates to suspension railroads in general and more particularly to a track crossing for a two-track suspension railroad.

In French Pat. No. 22 37 005, a track crossing for the carriage of a two track suspension railroad in which the track is formed by a slotted girder is disclosed. On both sides of the slot, tracks for support wheels arranged at the carriage are provided. The carriage is connected to a cabin via a suspension passing through the slot. At the four intersections of the tracks, triangular fillers are arranged in such a manner that two triangular fillers bridge each gap of the unused track. By rotating the four triangular fillers about a vertical axis, the ends of the rails of the other track can be connected to each other. Gaps then remain at the joints of the triangles. These joints become larger toward the outside in wedge-fashion, so that shocks occur when the crossing is negotiated.

SUMMARY OF THE INVENTION

It is an object of the present invention to describe a crossing in which a transition as smooth as possible from the switchable to the fixed rails and guide parts can be achieved.

In a crossing of the type mentioned at the outset, this problem is solved by using a box girder with parallel side walls forming lateral guide surfaces and using two settable support members having lateral guide surfaces for bridging the unused track, the support members pivoted about a vertical axis at the mutually opposite side-walls of the crossing track girders and adapted to be swung into depressions of the fixed sidewalls of the box girder of the one or other of the tracks, at least one of the support members being provided with current rails.

In the crossing according to the present invention only two tiltable support members are required for support and guidance, each of which has guide surfaces for the lateral guide wheels and, optionally, running surfaces for support wheels. At the transition points between the switchable and the fixed guide surfaces and the runway rails, the gap can be kept very small, so that shock-free guidance of the carriage in the switch can be achieved. As compared to the known design with the triangular switching members, the two tracks can be crossed not only at an angle of 90° but also at a very acute angle.

DETAILED DESCRIPTION OF THE INVENTION

Figure 1:
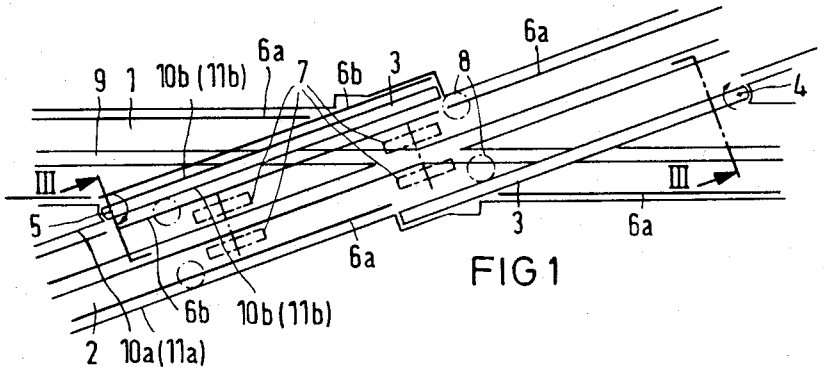
FIG. 1 is a top view onto a track crossing with a very acute crossing angle.
Figure 2:
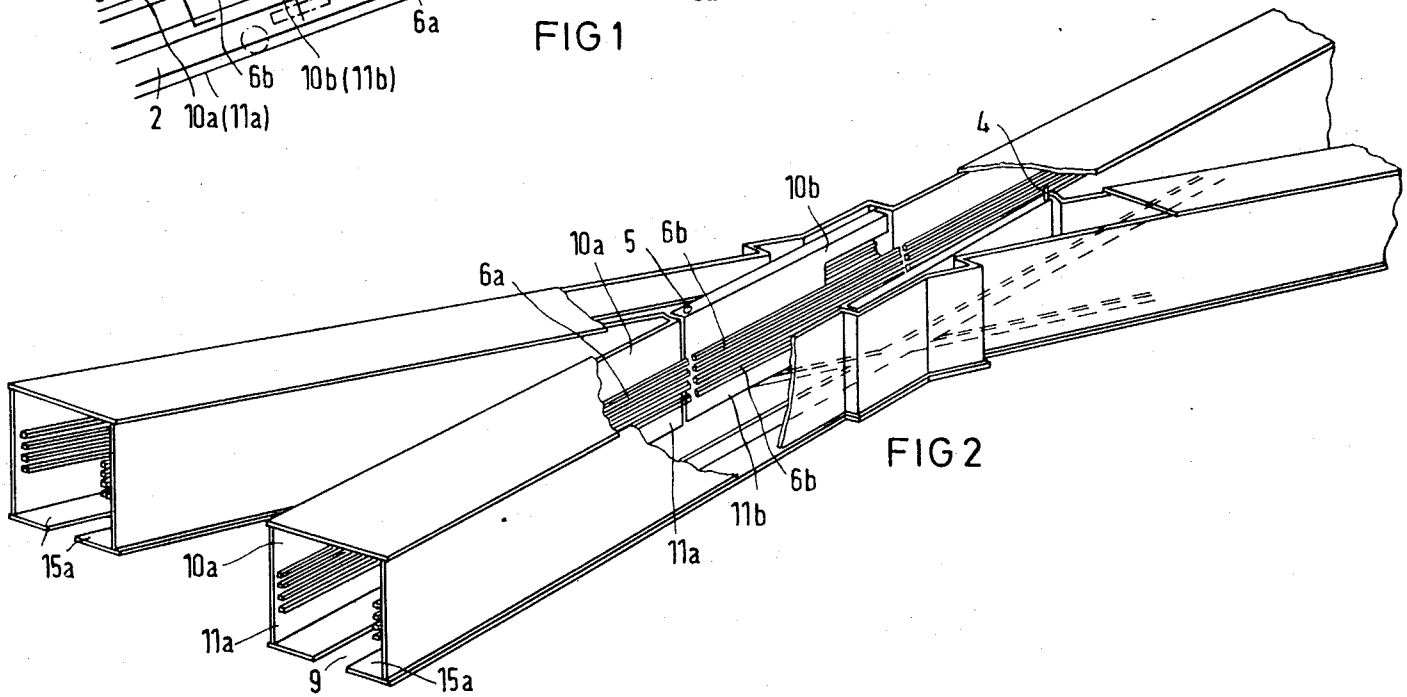
FIG. 2 is a perspective view of the crossing of FIG. 1.

In FIG. 1, a track girder 1 crosses a track girder 2 at a very acute angle. The two track girders 1 and 2 are designed as box girders (FIG. 2) and have on their underside a slot 9 for suspensions, between a carriage guided in the track girder and a cabin, to pass through. On both sides of the slot 9, the lower flange serves as the running surface 15*a* for the support wheels 7 (FIG. 1) of the carriage. The side walls of the box-shaped track girders 1, 2 are provided with current rails 6*a*, through which power is transmitted to the carriage via collector shoes. For the lateral guidance of the carriage guide rollers 8 which roll above and below the current rails 6*a* on upper guide surfaces 10*a* (FIG. 2) and lower guide surfaces 11*a* of the sidewalls of the track girders 1 and 2 are used.

In the crossing, settable support members 3 with upper lateral guide surfaces 10*b* and lower lateral guide surfaces 11*b* are used for bridging the respective unused track. At the plate-like support members 3, guide surfaces 10*b* and 11*b* are provided on both sides and, at least one of them, contains current rails 6*b*. The support members 3 are pivoted at the crossings of the mutually opposite sidewalls of the track girders 1 and 2 about vertical axes 4 and 5, and can be swung into depressions of the fixed sidewalls of the box girder of the one or the other track, so that smooth transitions between the guide surfaces 10*a*, 10*b* and 11*a*, 11*b* for the guide rollers 8 are obtained in the crossing even if the support element 3 is made heavy.

Figure 3:
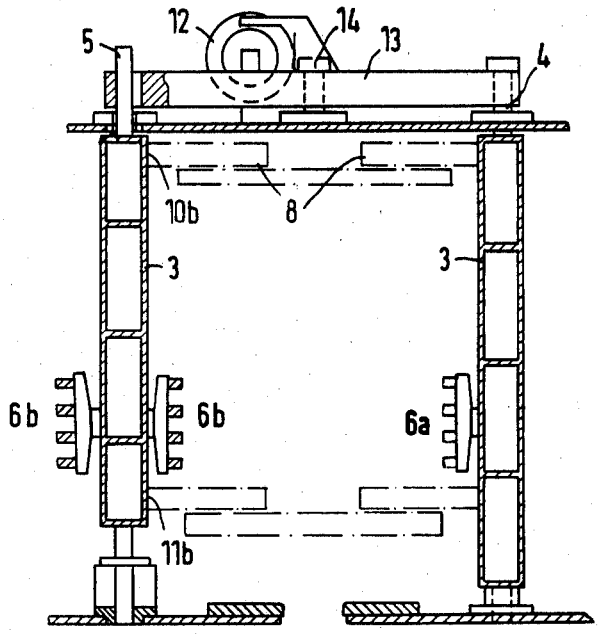
FIG. 3 is a cross section of FIG. 1.
Figure 4:
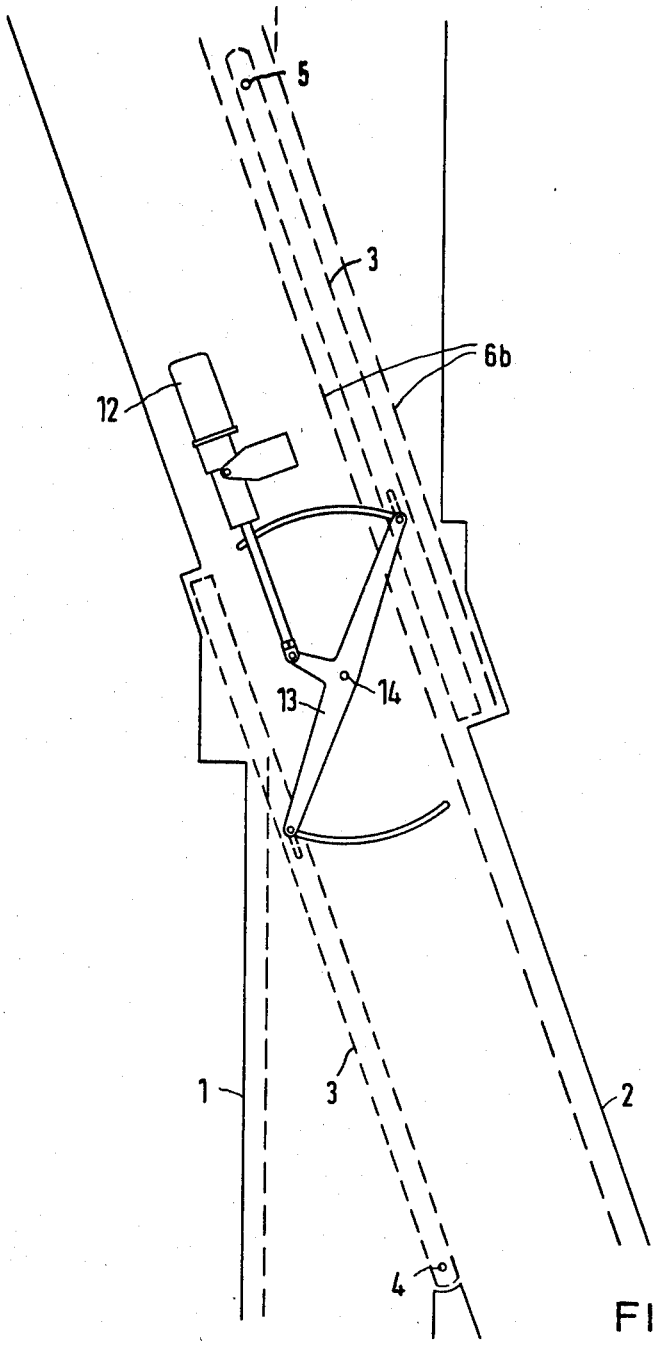
FIG. 4 is an actuator for the support members.

The two support elements 3 are driven, as can be seen from FIG. 3, by a positioning cylinder 12 via a lever 13 (FIG. 4) which is pivoted at the post 14. The positioning cylinder 12 is mounted to the upper flange of the two crossing, box shaped track girders 1 and 2 (FIG. 3). Along the vertical axis 4 is a pivot bearing and along the vertical axis 5 a rocking lever bearing so that the support member 3 supported on the axis 5 executes a height adjustment during the swinging motion relative to the support member 3 supported on the axis 4.

Figure 5:
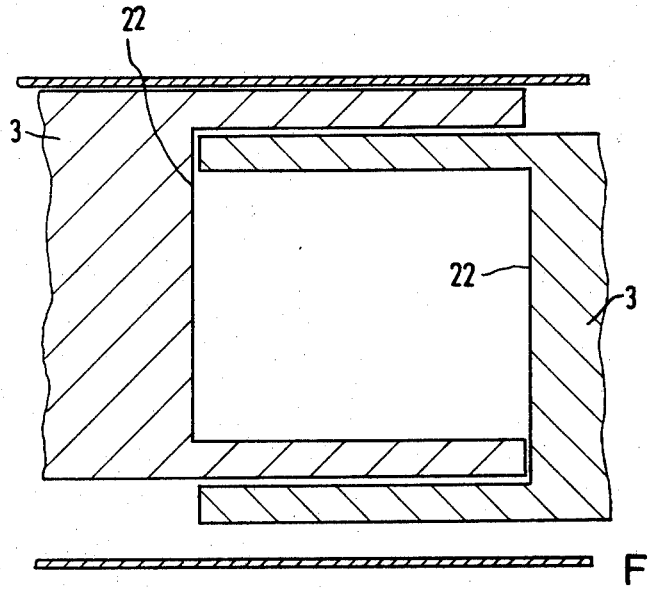
FIG. 5 is a view of the ends of the two pivoted support members during the swing motion, in a central position in which the two planes of the support members are aligned with each other.

The free ends of the support members 3 have recesses 22 in order to allow mutual slewing of the support members 3 even in the case of an acute crossing (FIG. 5).

Figure 6:
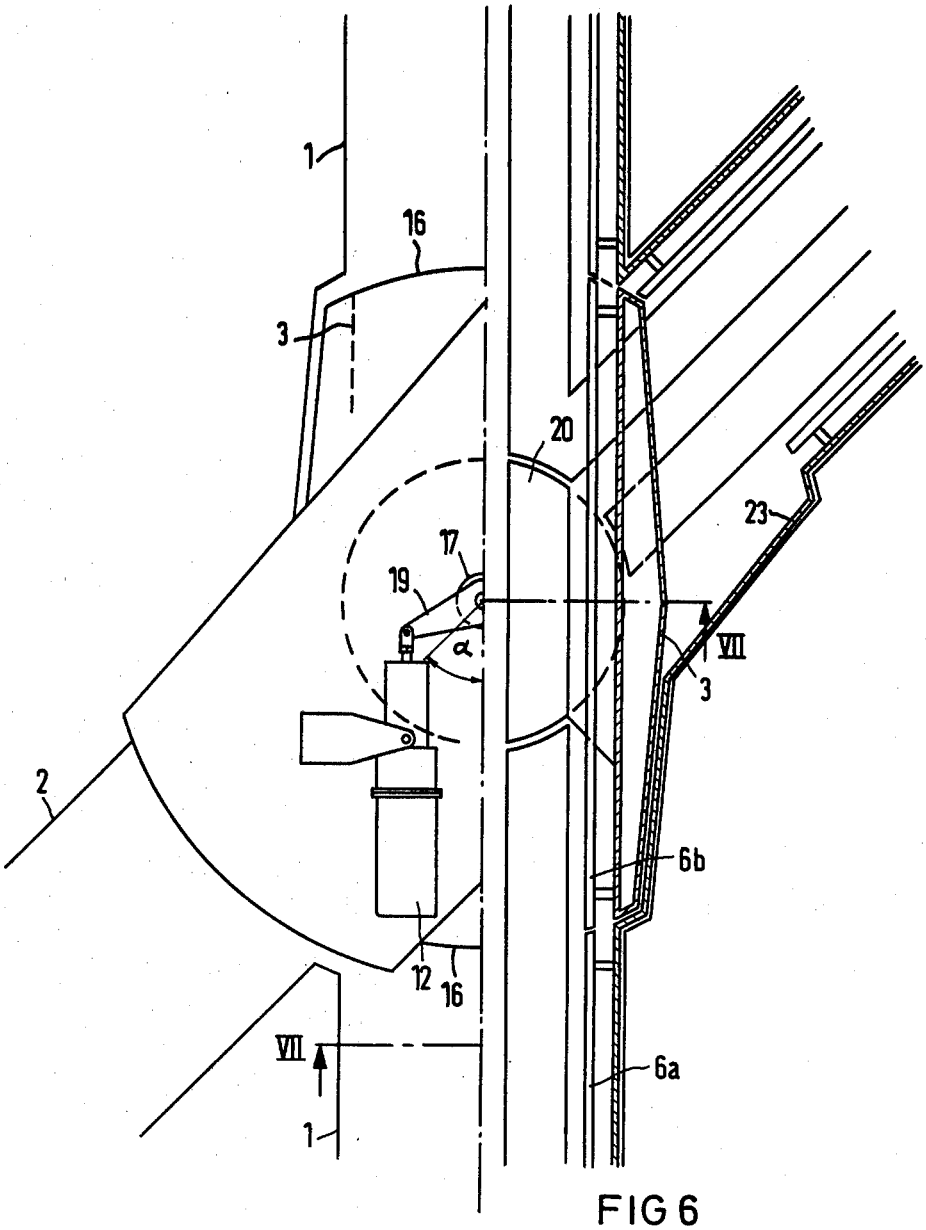
FIG. 6 is a partial cross section of support members firmly connected by a common cross beam, with guide surfaces for an acute crossing.
Figure 7:
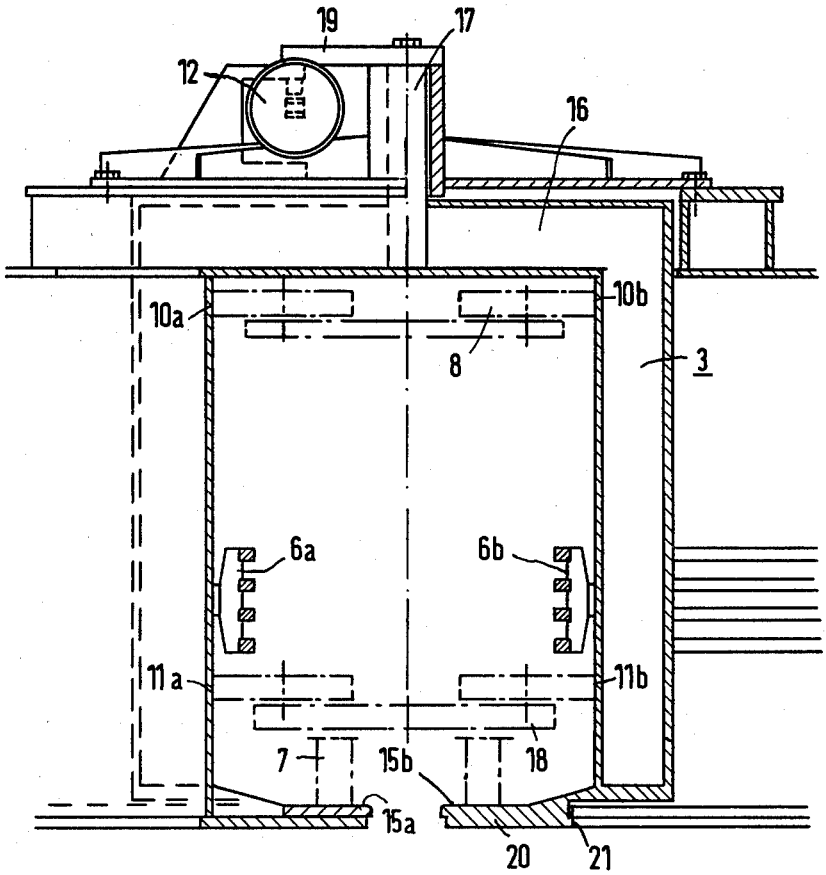
FIG. 7 is a cross section along the section line VII—VII of FIG. 6.

In the crossing shown in FIG. 6 and FIG. 7, the two support members 3 are provided with the lateral guide surfaces 10*b* and 11*b* on one side, along with current rails 6*b* and running surfaces 15*b* (FIG. 7) for support wheels of the carriage 18 and are rigidly connected to each other via a cross beam 16. The cross beam 16 is supported in the upper flange of the crossing track girders in a pivot 17 which is in functional connection with a hydraulic positioning cylinder 12 arranged on the upper flange. A lower part 20 of the support member 3, provided with running surfaces 15*b* for support wheels, is designed in the manner of a circular segment and is supported in an abutment 21 of the lower flange.

If the hydraulic positioning cylinder 12 executes a lifting motion, the cross beam 16 with the support members 3, which have the shape of plates and are arranged thereon, are rotated by the angle in such a manner that the plates 3 are swung into depressions 23 of the fixed sidewalls of the box girder of the other track.

What is claimed is:

1. In a track crossing for a carriage of a two-track suspension railroad arranged in a track girder, in which running surfaces for support wheels are provided on both sides of a slot provided in the track girder, through which a suspension connecting the carriage to a cabin passes, the improvement comprising:

(a) the track girder being a box girder, at the sidewalls of which parallel guide surfaces for lateral guide wheels and current rails are arranged, (b) two settable support members having lateral guide surfaces for bridging the unused track pivoted for swinging motion at the mutually opposite sidewalls of the crossing track girders about vertical axes;

(c) depressions in the sidewalls of the box girders in the one or the other track into which said support members can be swung; and (d) current rails on at least one of said support members.

2. The improvement according to claim 1, and further including means to rotate at least one of the support members such that it executes an evasive motion in the vertical direction relative to the other support member during swinging motion.

3. The improvement according to claim 1, wherein said support members are disposed on a cross beam pivoted in the upper flange of the crossing track girders.

4. The improvement according to claim 1, 2 or 3 wherein said support members are designed as plates.

5. The improvement according to claim 2 or 3, and further including running surfaces for support wheels provided at said support members.

* * * * *